US005377655A

United States Patent [19]

Arad

[11] Patent Number: 5,377,655

[45] Date of Patent: Jan. 3, 1995

[54] PROJECTILE-PROPELLING TOY AND KIT THEREFOR

[75] Inventor: Avi Arad, Westport, Conn.

[73] Assignee: Toy Biz, Inc., New York, N.Y.

[21] Appl. No.: 997,718

[22] Filed: Dec. 31, 1992

[51] Int. Cl.[6] ..... F41B 7/00; F41B 11/00

[52] U.S. Cl. ..... 124/65; 124/64; 124/66; 124/63; 124/67

[58] Field of Search ..... 124/63, 64, 65, 66, 124/67; 446/63, 64, 192, 196, 211, 212, 429, 430, 473; 273/129 R, 129 AP, 129 S, 129 T

[56] References Cited

U.S. PATENT DOCUMENTS

| | | | |
|---|---|---|---|
| 786,426 | 4/1905 | Daniels . | |
| 1,171,197 | 2/1916 | Harmon, Jr. . | |
| 1,172,766 | 2/1916 | Chein . | |
| 1,217,553 | 2/1917 | Beatty | 124/65 |
| 2,345,173 | 3/1944 | Baggott | 446/192 |
| 2,505,428 | 4/1950 | Pope . | |
| 2,630,108 | 3/1953 | White . | |
| 2,725,868 | 12/1955 | Foster . | |
| 2,725,869 | 12/1955 | Barber . | |
| 2,733,699 | 2/1956 | Krinsky . | |
| 2,762,357 | 9/1956 | Foster . | |
| 2,853,991 | 9/1958 | McLain . | |
| 2,991,782 | 7/1961 | Ayala . | |
| 2,993,297 | 7/1961 | Bednar et al. . | |
| 3,120,387 | 2/1964 | Weinstein . | |
| 3,236,521 | 2/1966 | Knott . | |
| 3,301,246 | 1/1967 | Wolfe . | |
| 3,566,537 | 3/1971 | Tepper et al. . | |
| 3,709,495 | 1/1973 | Krombein | 446/430 |
| 3,739,764 | 6/1973 | Allport . | |
| 3,744,472 | 7/1973 | O'Ryan . | |
| 3,765,396 | 10/1973 | Keinholz et al. . | |
| 3,903,865 | 9/1975 | Kaneko . | |
| 4,076,006 | 2/1978 | Breslow et al. . | |
| 4,438,587 | 3/1984 | Marino . | |
| 4,548,190 | 10/1985 | Megargee . | |
| 4,710,146 | 12/1987 | Rasmussen et al. . | |
| 4,892,081 | 1/1990 | Moormann . | |
| 4,897,065 | 1/1990 | Fertig et al. . | |
| 5,242,323 | 9/1993 | Rappaport | 446/211 |
| 5,267,549 | 12/1993 | Webber | 124/65 |

FOREIGN PATENT DOCUMENTS

| | | | |
|---|---|---|---|
| 460984 | 11/1949 | Canada | 124/66 |
| 627729 | 9/1961 | Canada | 446/212 |
| 1017630 | 12/1952 | France . | |
| 161492 | of 1921 | United Kingdom | 446/473 |
| 1631245 | 2/1991 | U.S.S.R. | 446/473 |

OTHER PUBLICATIONS

Undated sheet showing Topper's Johnny Seven One Man Army Gun (acknowledged to be prior art).

VCR Advertisement for Johnny One Man Army Gun.

*Primary Examiner*—Randolph A. Reese
*Assistant Examiner*—Anthony Knight
*Attorney, Agent, or Firm*—Amster, Rothstein & Ebenstein

[57] ABSTRACT

A projectile-propelling toy includes a first port and a first propulsion mechanism for propelling a projectile via the first port as well as a second port and a second propulsion mechanism for propelling a projectile via the second port. The first and second propulsion mechanisms are separate and independent, at least one of the first and second propulsion mechanisms being pneumatic. A kit for the toy includes a housing having an engaging element for releasably receiving a first weapon and a cavity for telescopically receiving at least a major portion of a second weapon. A magazine is adapted to be releasably received in functional engagement by each of the first weapon, the second weapon and the housing. One weapon includes a manually-driven pneumatic propulsion mechanism for propelling a projectile, a spring-driven pneumatic propulsion mechanism for propelling a projectile, and a selector for manually selecting which of the pneumatic propulsion mechanisms is operative at a given time.

33 Claims, 11 Drawing Sheets

PROJECTILE-PROPELLING TOY AND KIT THEREFOR

BACKGROUND OF THE INVENTION

The present invention relates to a projectile-propelling toy and a kit therefor, and more particular to such a toy and kit having a plurality of separate and independent propulsion means, at least one of the propulsion means being pneumatic.

In view of the limited interest span of children in any single-concept toy, there has been an attempt to increase the play value of toys by providing multi-concept toys which can convert from one single-concept toy to another single-concept toy or in which the multi-concept toy is separable into a plurality of single-concept toys. Exemplary of the first category is the toy which converts from a building to an action figure (such as a robot) and back again so that the child can play with either the building or the action figure. Exemplary of the second category is a rifle with a detachable bayonet so that the child can play with the bayonetted rifle as one toy, the separated bayonet as a second toy, and the separated rifle as a third toy. From the point of view of the manufacturer/seller of the toy, the multi-concept toy is attractive as the manufacturer/seller has only to manufacture, advertise and sell the single toy rather than two or three separate ones, and because he can charge more than he could for any one of these single-concept toys alone because of the added play value, while still underselling a competitor who must manufacture, advertise and sell an equivalent plurality of the single-concept toys.

Currently toys incorporating pneumatic propulsion means for propelling a projectile from a port are especially popular. The pneumatic propulsion means uses compressed air to project either a rigid projectile out of a port having a resilient seal (which precludes propelling the projectile therefrom until a sufficient pressure has been built up to deform the seal sufficiently to enable the projectile to enable its passage through the deformed seal) or a resilient projectile out of a port having a rigid seal (which precludes propelling the projectile therefrom until sufficient pressure is built up to deform the projectile sufficiently to enable its passage through the rigid seal).

In either case, the pneumatic propulsion means may be either manually-driven or spring-driven. In a manually-driven pneumatic propulsion means, the user compresses the air (typically through an arm motion driving a piston into a cylinder) at the instant that the projectile is being forced past the seal. In other words, the compressing stroke actually drives the projectile through the seal of the port. By way of contrast, in a spring-driven pneumatic propulsion means, the user first manually loads a spring (e.g., by manually compressing or extending the spring) and, then, by releasing the spring, allows the loaded spring to unload, thereby simultaneously compressing the air and forcing the projectile past the seal. One disadvantage of the typical spring-driven pneumatic propulsion means from the aspect of safety is that the spring may be retained in a loaded condition (i.e., with stored energy) until released by a trigger, button or like releasable engaging mechanism when propelling of the projectile is desired. Another disadvantage of a spring-driven pneumatic propulsion means is that the force with which the projectile is driven is limited by the power of the spring, which may be less than the power that even a child can generate directly. Thus it would be desirable to have a multi-concept toy having a convertible pneumatic propulsion means which could be either spring-driven or manually-driven, as desired by the user depending upon the application, his mood, his strength and the like.

Accordingly, an object of the present invention is to provide a multi-concept projectile-propelling toy which incorporates a plurality of single-concept toys.

Another object is to provide such a toy which includes a plurality of ports and a plurality of propulsion means for propelling a variety of different types of projectiles via the posts, the various propulsion means being separate and independent and at least one being pneumatic.

A further object is to provide a kit which includes such a toy and a magazine which enables repeated firing of projectiles from the various propulsion means without reloading.

It is also an object of the present invention to provide a convertible projectile-propelling toy wherein the user can select between manually-driven and spring-driven pneumatic propulsion means for added play valve.

SUMMARY OF THE INVENTION

It has now been found that the above and related objects of the present invention are obtained in a projectile-propelling toy according to the present invention.

A first embodiment of the projectile-propelling toy comprises a first port and a first propulsion means for propelling a projectile via the first port, and a second port and a second propulsion means for propelling a projectile via the second port. The first and second propulsion means are separately and independently driven, at least one of the first and second propulsion means being pneumatic. Optionally the toy also includes a third port and a third propulsion means for propelling a projectile via the third port. Preferably at least two of the propulsion means are simultaneously operable. The toy is easily and reversibly separable into two independent and distinct projectile-propelling devices, each device having a respective one of the first and second ports and a respective one of the first and second propulsion means.

In a preferred embodiment each of the propulsion means is pneumatic. At least one of the propulsion means is manually-driven, and at least another of the propulsion means is spring-driven. At least two of the propulsion means are configured to propel projectiles via the same one of the ports, preferably a manually-driven propulsion means and a spring-driven propulsion means. Means are provided for manually selecting which of the two propulsion means is operable to propel a projectile via the same one of the ports. Some of the projectiles are adapted for being propelled via a large diameter female member and others of the projectiles are adapted for being propelled via a small diameter male member, and the toy additionally includes conversion means releasably securable to at least one of the ports for converting the one port from a large diameter female member to a small diameter male member.

The present invention also encompasses a kit for a projectile-propelling toy comprising a first weapon including first pneumatic propulsion means for propelling a projectile therefrom and a second weapon including second pneumatic propulsion means for propelling a projectile therefrom. The kit also includes a housing, including means for releasably receiving the first weapon thereon and means for telescopically receiving at least a major portion of the second weapon therein, and a magazine adapted to be releasably received in functional engagement by each of the first and second weapons.

In a preferred embodiment the housing telescopically receives at least a major portion of the second weapon therein, the second propulsion means being operable in the housing. The magazine enables rapid multiple firing of projectiles by the weapon on which it is mounted without reloading. An elbow is provided to enable directional guidance of the airflow from the second weapon when mounted thereon. The kit additionally includes as projectiles at least one ball, at least one arrow, at least one missile, and at least one plane.

Preferably, the second weapon additionally includes third pneumatic propulsion means for propelling a projectile therefrom, the third propulsion means being spring-driven, the second propulsion means being manually-driven, and means being provided for selecting which of the second and third propulsion means is operative at a given time.

The present invention further encompasses a convertible projectile-propelling toy comprising manually-driven pneumatic propulsion means for propelling a projectile therefrom, spring-driven pneumatic propulsion means for propelling a projectile therefrom, and means for manually selecting which of the pneumatic propulsion means is operative at a given time.

In a preferred embodiment the toy includes first and second ports, the manually-driven propulsion means driving a projectile via the first port, and the spring-driven propulsion means driving a projectile via the second port, the first and second ports being either the same or different. When different, means are also provided for releasably sealing a port, the sealing means being manually switchable between a first position sealing the first port and a second position sealing the second port. Each of the manually-driven and spring-driven propulsion means is capable of propelling a projectile through either one of the first and second ports when the sealing means is in a position sealing the other of the first and second ports.

The present invention finally encompasses a projectile-propelling toy having a primary power unit comprising an axially extending tube having a front end, a back end, a sidewall joining the tube front and back ends, and a hollow tube interior. A plurality of ports are in gaseous communication with the tube interior for propelling a projectile therefrom, one of the ports extending through the tube front end and one of the ports extending through the tube sidewall. Piston means extend through the tube back end and into the tube interior for axial movement relative to the tube for pneumatically propelling a projectile via one of the ports. Preferably the primary power unit additionally includes biasing means for causing relative movement of the piston means and the tube.

In a preferred embodiment the toy includes a housing defining a hollow interior configured and dimensioned to telescopically receive therein at least a portion of the primary power unit, and an exterior including means for releasably securing to the primary power unit at least one additional device (and preferably two). The toy further includes means secured to the primary power unit for releasably sealing against gaseous communication a selected one of the ports, a missile launcher, and a hollow elbow means releasably securable to a port for modifying the direction of travel of a projectile propelled via the port and through the elbow means. The elbow means defines a first end defining a port, a second end for releasable connection to one of the ports of the primary power unit for establishing gaseous communication with the tube interior, and a body connecting the elbow means ends and defining a fixed angle of 35°–55°. The elbow means free end is configured and dimensioned for releasable connection with a hollow missile launcher for gaseous communication therewith, the launcher including magazine means for storing a plurality of projectiles for firing from the launcher.

BRIEF DESCRIPTION OF THE DRAWING

The above and related objects, features and advantages of the present invention will be more fully understood with reference to the following detailed description of the presently preferred, albeit illustrative, embodiments of the present invention when taken in conjunction with the accompanying drawing wherein.

DESCRIPTION OF THE PREFERRED EMBODIMENTS

Figure 1:
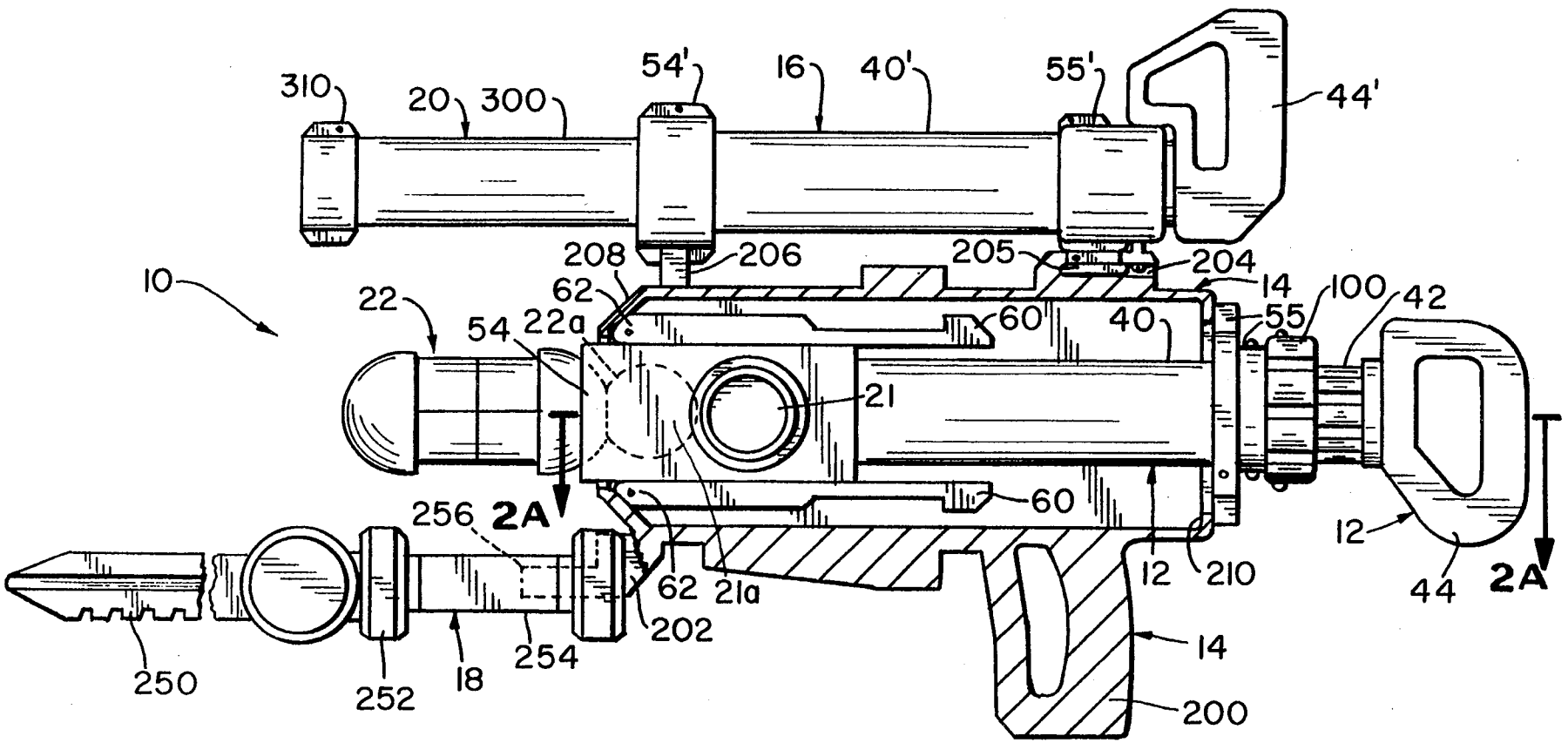
FIG. 1 is a side elevational view of a toy according to the present invention, with a grenade projectile thereon, with portions thereof removed to reveal details of internal construction.

Referring now to the drawing, and in particular to FIG. 1 thereof, therein being illustrated is a multi-concept toy according to the present invention, generally designated by the reference numeral 10. In its basic aspects, the toy 10 comprises a primary weapon generally designated 12, a housing generally designated 14 which defines a hollow or cavity releasably telescopically receiving at least a major portion of the primary weapon 12 therein, a pistol generally designated 16 which is releasably mounted on the top of the housing 14, and a bayonet generally designated 18 which is releasably mounted in front of the housing 14. The toy 10 is illustrated in FIG. 1 as including a removable and relocatable magazine generally designated 20 which serves as an ammunition clip containing a plurality of projectiles, a cap 21 and, as one of the projectiles which may be fired from the toy, a grenade generally designated 22. Other projectiles which may be fired by the toy 10 (besides grenade 22) include bullet- or missile-like balls 24 (see FIGS. 2 and 5–6), planes generally designated 28 (see FIGS. 7 and 9–10) and arrows generally designated 30 (see FIGS. 8–10). The toy 10 may additionally include an elbow 26 useful for redirecting airflow and also useful as a separate carrier for various accessories not shown in FIG. 1 (see FIGS. 9–10) and a conversion means 70 (see FIGS. 7–8 and 10).

The Primary Weapon—Manually Driven

Figure 2A:
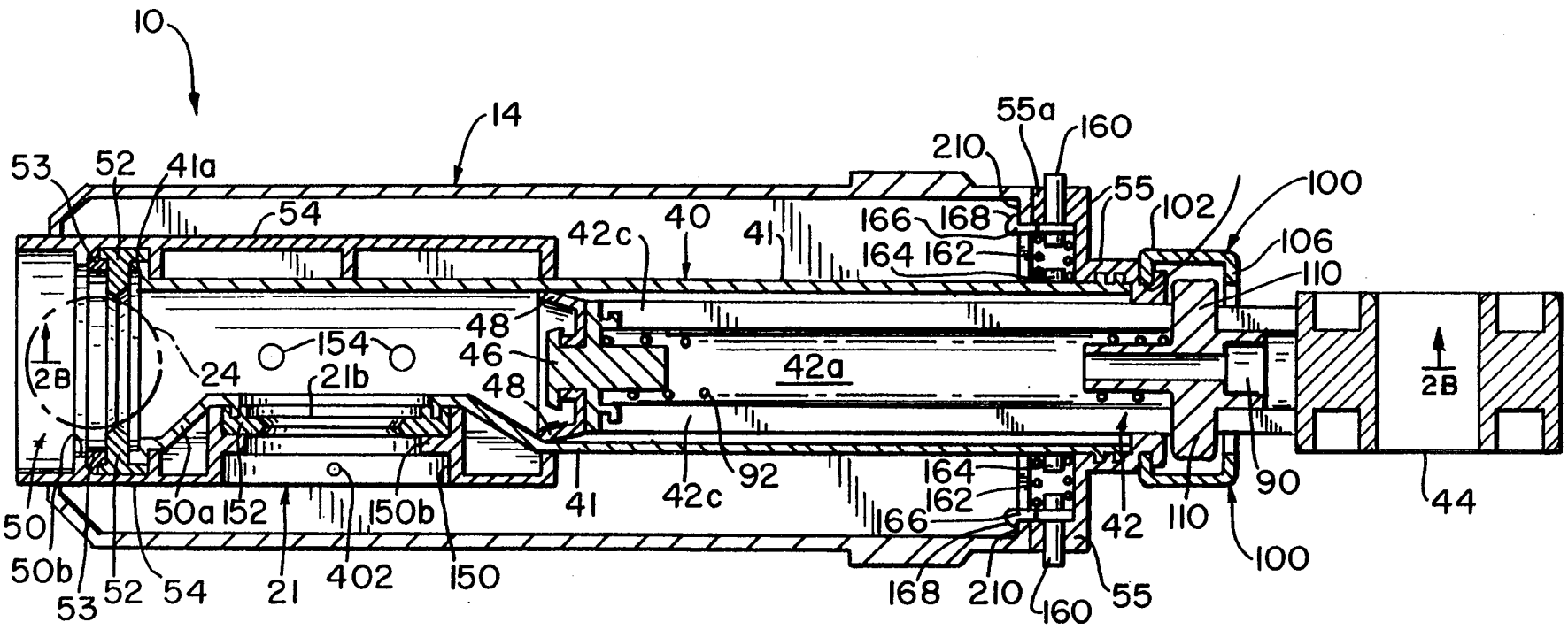
FIG. 2A is a horizontal sectional view of the primary weapon and housing thereof, taken along the line 2A—2A of FIG. 1, with a ball projectile illustrated in phantom line.
Figure 2B:
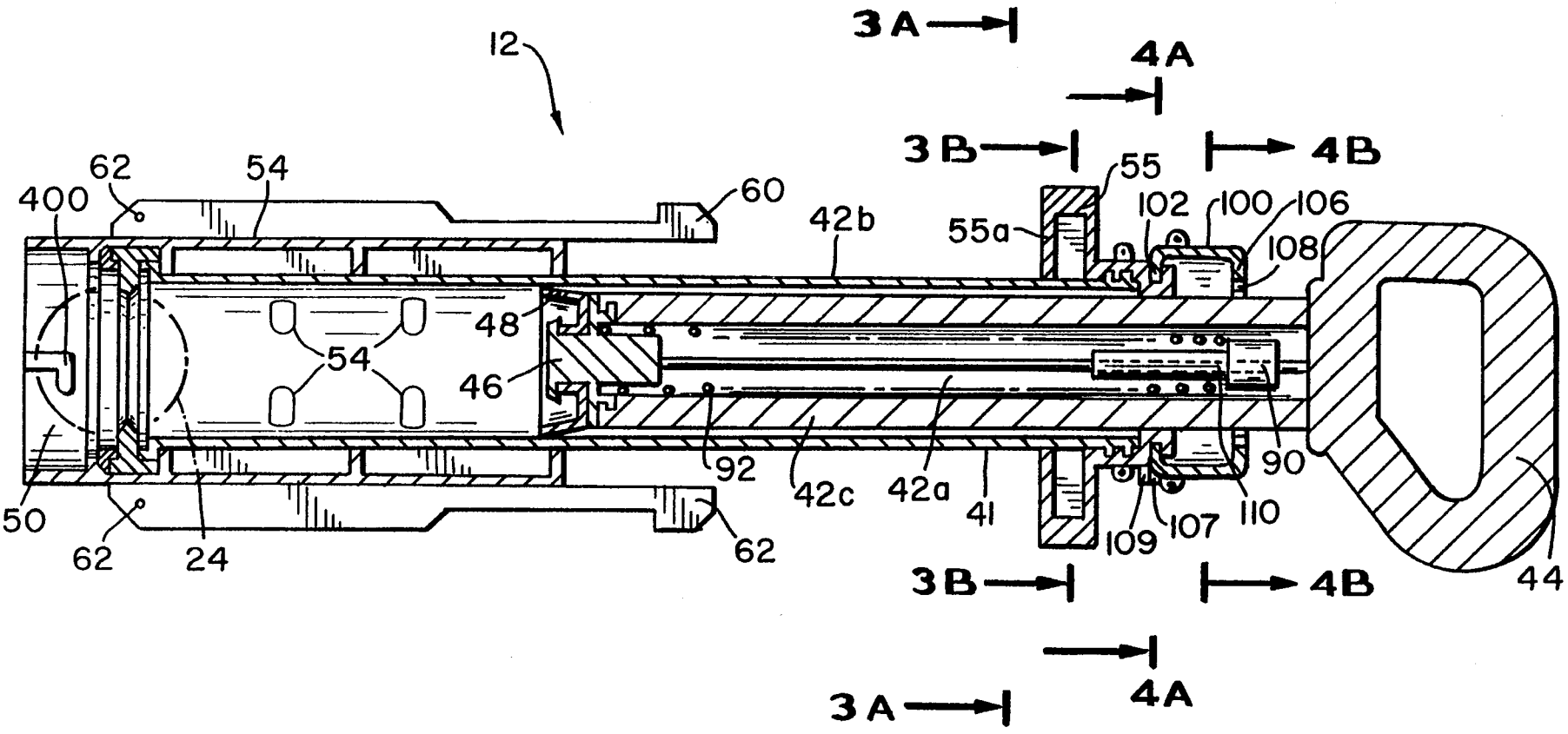
FIG. 2B is a vertical sectional view of the primary weapon, with a ball projectile illustrated in phantom line, taken along the line 2B—2B of FIG. 2A.
Figure 5:
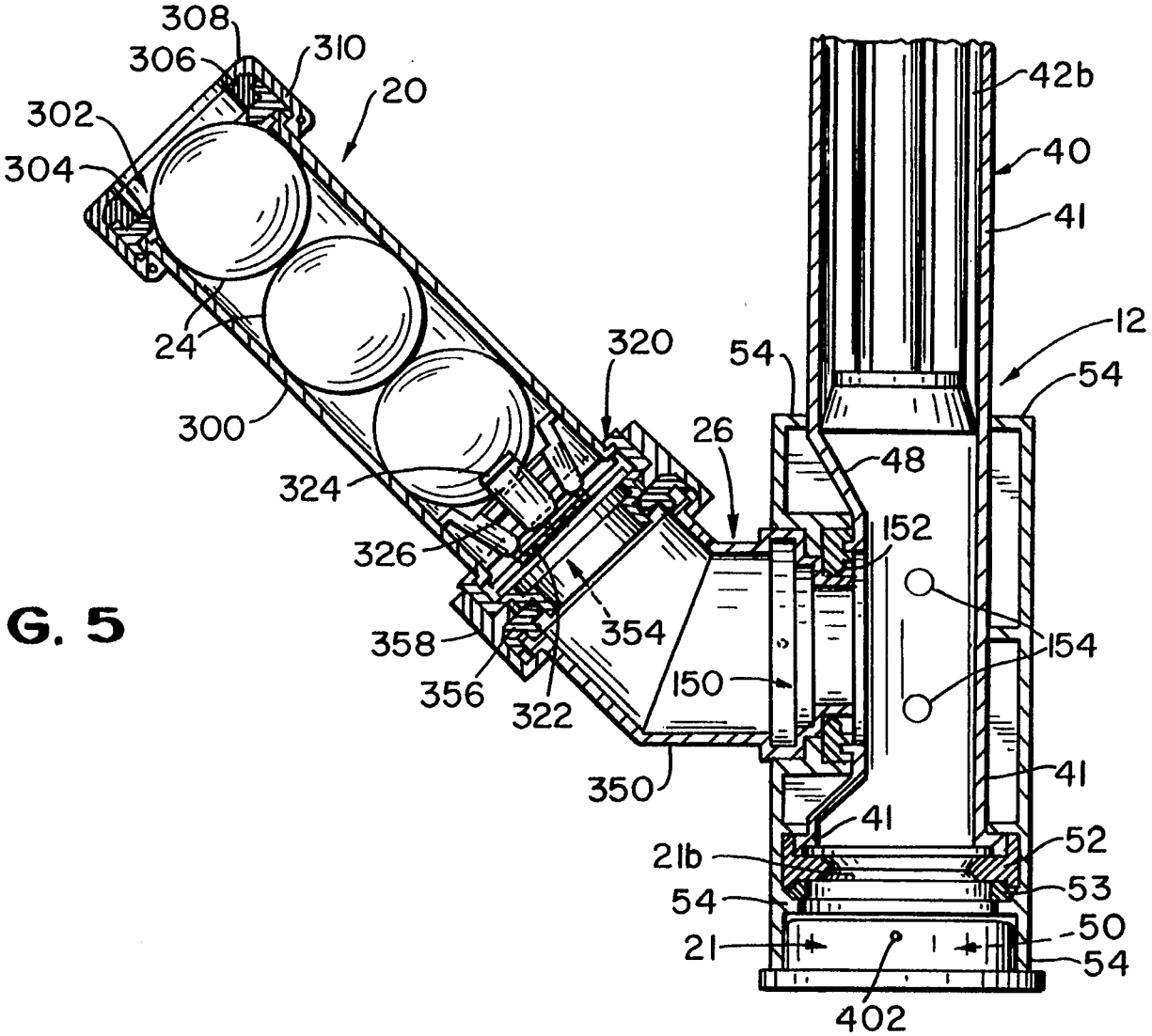
FIG. 5 is a fragmentary side sectional view of the primary weapon with an elbow and a ball-filled magazine attached, for use as a missile launcher.
Figure 7:
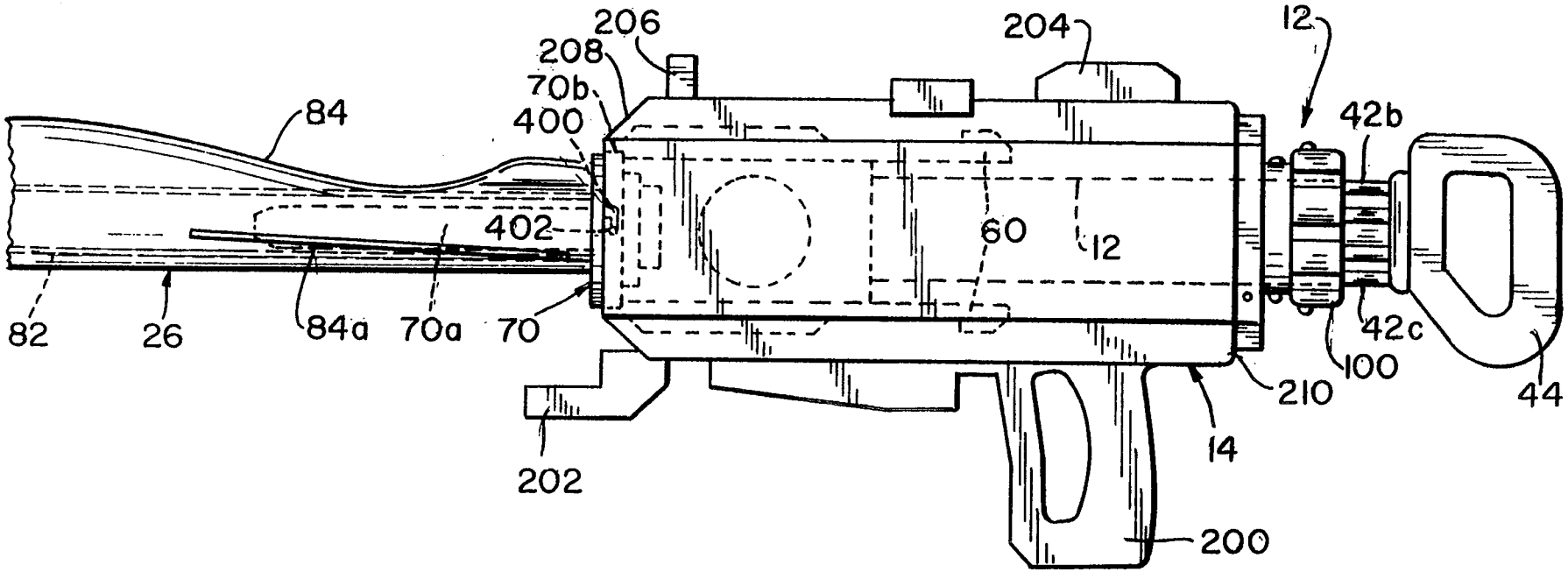
FIG. 7 is a fragmentary side elevational view of the primary weapon with a housing, conversion means and a plane projectile attached, for use in launching a plane.

Referring now to FIGS. 2A and 2B, therein illustrated are the primary weapon 12 and a projectile ball 24 (the housing also being illustrated in FIG. 2A). As the primary weapon 12 includes the primary pneumatic propulsion means, it is capable of a variety of different uses—for example, as an air canon (as illustrated in FIGS. 1 and 2), a missile launcher (as illustrated in FIG. 5), a plane launcher (as illustrated in FIG. 7). For rapid-firing without reloading, the magazine 20 is also disposed on the operative port of the missile launcher (as illustrated in FIG. 5) or air cannon.

Still referring to FIG. 2, the primary weapon 12 comprises a tube or cylinder 40 having two ends and an airtight sidewall 41 of substantial length therebetween and, at least partially within the cylinder 40, a piston 42 of four-leaf clover-like cross section adapted for travel along a major length of the cylinder 40. The outside of the cylinder 40 is adapted to be manually held, thereby to facilitate forcible movement of the piston 42 relative to the cylinder 40. The piston 42 has at the projecting or back end thereof a handle 44 for grasping by the user. At the other or front end, within cylinder 40, the piston 42 defines a head 46 including an outwardly biased resilient sealing member 48 configured to make a substantially airtight connection with the surrounding inner surface of the cylinder sidewall 41 as the piston 42 moves forwardly (to the left as illustrated in FIG. 2) within cylinder 40.

Adjacent to the front of the cylinder 40 is a chamber or port, generally designated 50, adapted to releasably receive and have propelled therefrom a substantially rigid ball 24 (or, as will be explained hereinafter, the substantially rigid rear end **22*a* of a grenade 22). A resilient seal 52 is disposed within the port 50 and extends inwardly. The seal 52 is held in place by a rigid ring 53 in front and the front 41*a* of rigid sidewall 41 in back. Ring 53 extends inwardly further in front of the seal 52 than does sidewall front 41*a* behind the seal 52, thereby to facilitate resilient flexing of the seal 52 rearwardly (as when a ball 24 is being inserted into the port 50) while impeding resilient flexing of the seal 52 forwardly (as when a ball 24 within port 50 is biased thereagainst or being propelled therefrom). The port 50 has a full diameter middle portion (slightly larger than the ball) containing the seal 52, a narrowing neck portion 50*a* therebehind (defined by sidewall 41) which limits rearward movement of the ball 24 from the port 50 into the remainder of cylinder 40, and a stepped chamber 50*b* extending forwardly from seal 52** with steps of increasing inner diameter.

The port 50 is in pneumatic communication with the interior of cylinder 40. Thus, as piston handle 44 is driven forwardly by the user and piston head 46 advances into the cylinder 40, the pressure of the air forced forwardly by the piston head 46 (including the resilient sealing member 48) within cylinder 40 increases until the ball 24 eventually overcomes the resilient resistance of the seal 52 and forwardly displaces the inner circumference thereof, so that the ball 24 is pneumatically propelled out of the chamber 50. The ball 24 may travel as far as 25 feet, or even further, depending upon the force and speed with which the piston handle 44 is manually driven.

The cylinder 40 is preferably blow molded to ensure the airtight integrity of the sidewall 41 thereof and, accordingly, it is difficult to provide a desirable level of detail on the outer surface thereof. Accordingly, in order to provide such surface detail and to reinforce the ends of the cylinder 40, collar-like front and back end pieces 54, 55 are provided, these end pieces 54, 55 preferably being injection molded since injection molding lends itself to a high level of surface detail and rigidity in the product. The front end piece 54 defines the stepped front portion **50*b* of the port 50, as the front end 41*a* of the blow-molded cylinder 40 simply terminates immediately behind the seal 52 to urge forwardly the rear end of the seal 52. Either a shoulder of the front end piece 54 or, as illustrated for port 50, a separate rigid ring element 53 may be used to urge rearwardly the front end of seal 52**.

Regardless of the nature of the projectile 22,24,28,30, operation of the primary weapon 12 as described hereinabove is a use thereof as a manually-driven pneumatic propulsion means. Accordingly, the user feels that the force and speed with which the ball or grenade projectiles 22,24 are propelled from the weapon 12, and the speed and flight distance attained by the plane and arrow projectiles 28,30, is somehow related to the force and speed with which the piston handle 44 is manually driven toward the cylinder 40 of the primary weapon 12 and, indeed, there is obviously substantial validity to this feeling.

Figure 8:
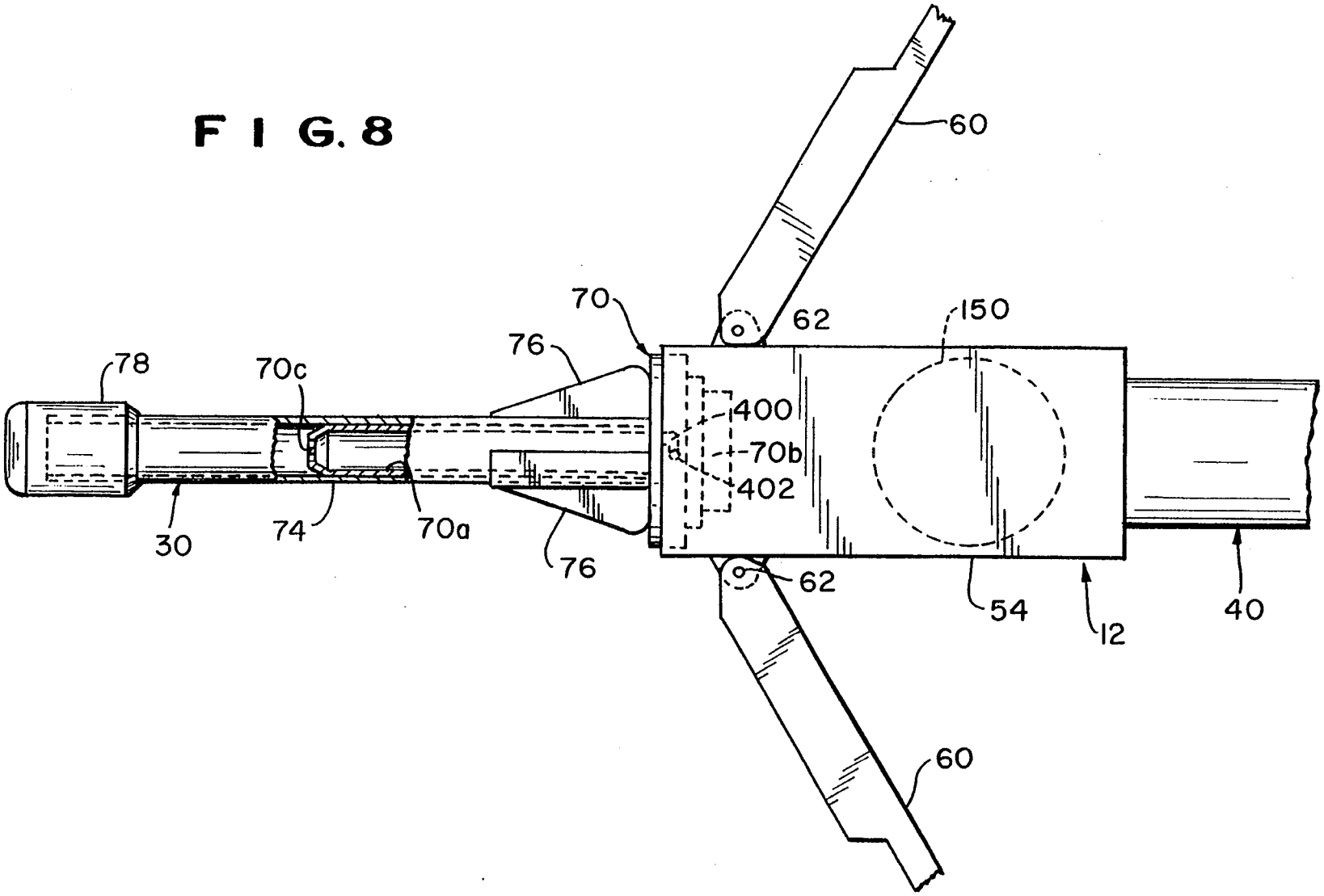
FIG. 8 is a fragmentary side elevational view of the primary weapon, with conversion means and an arrow projectile attached, for use as a crossbow.

For reasons which will become apparent hereinafter, two bow arms 60 are provided on front end piece 54. Each bow arm 60 is pivotally secured at a respective diametrically opposed point 62 to the front end of the primary weapon 12 so that the bow arms 60 may be pivoted from a less conspicuous orientation substantially longitudinally aligned with the cylinder 40 of the primary weapon 12 as illustrated in FIGS. 1, 2B and 7) to a more conspicuous orientation extending vertically outwardly of the cylinder 40, preferably at about 25–65 degrees, and optimally 45 degrees, so as to resemble the resilient portion of a vertically oriented cross-bow (as illustrated in FIG. 8). The bow arms 60 are, however, non-functional in that they play no role in propelling the arrow 30 or any other projectile 22, 24, 28 from the primary weapon 12.

The Primary—Spring-Driven

The primary weapon 12 can also be operated as a spring-driven pneumatic propulsion means. This might be preferred where the act of ramming the handle 44 toward the cylinder 40 does not mimic or simulate the operation of the real weapon. For example, where the real weapon (e.g., a cross-bow) relies on the user cocking or loading a biasing means (e.g., pulling back against a spring bias) and then subsequently releasing the biasing means so that the built-up tension therein propels the projectile, a spring-driven propulsion means more closely parallels and mimics the action being contemplated by the user. Thus, referring now to FIGS. 2A and 2B, the split piston 42 within the primary weapon 12 is formed of two separate longitudinal pieces, an upper piece 42*b* and a lower piece 42*c*, extending from handle 44 to piston head 46 and defining an interior hollow 42*a* therebetween. A stepped cylindrical base 90 is slidably mounted within hollow 42*a* and defines a pair of flat ears 110 which extend laterally outwardly between and beyond the longitudinal pieces 42*b*, 42*c* in a fixed horizontal plane. A helical compression spring 92 is disposed in hollow 42*a* and has a forward end mounted on and disposed against the back of piston head 46 within hollow 42*a* and a rear end mounted on and disposed about the front of base 90 within hollow 42*a*.

Figure 4B:
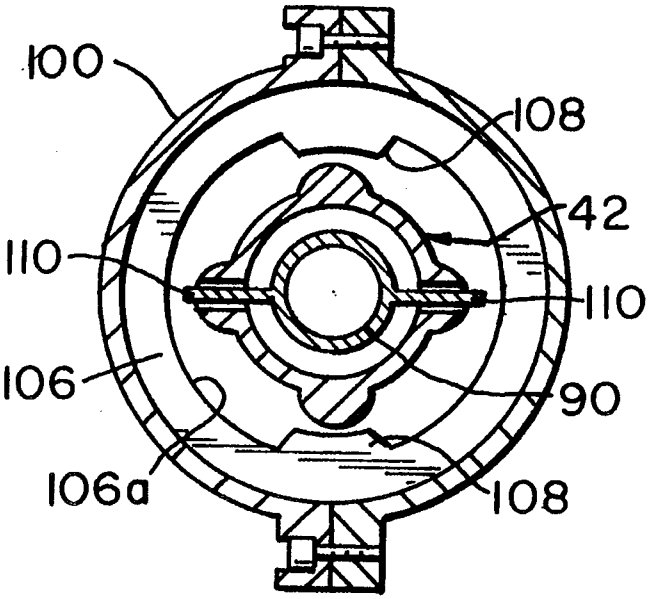
Figure 4A:
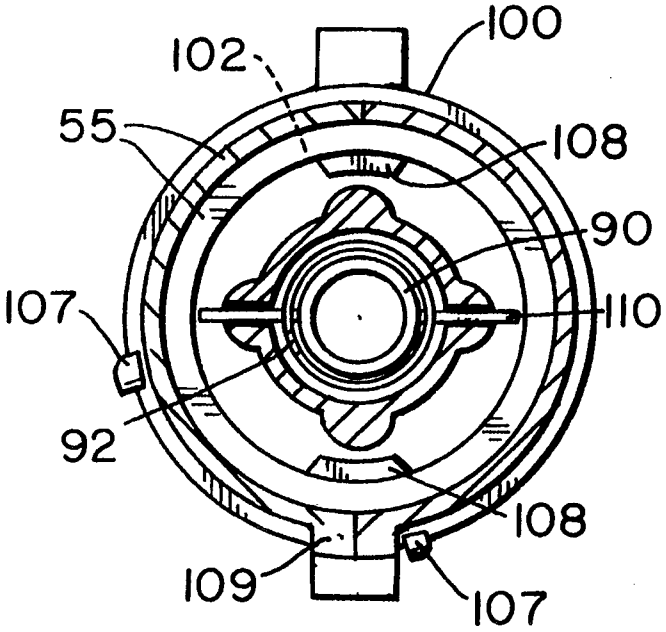

A rotatable circular selector 100 has its peripheral segments define a U-shaped cross section with the front leg 102 thereof fixed in a groove 104 on the outer circumference of the back end piece 55, so as to preclude relative longitudinal motion of the selector 100 and the cylinder 40, and the back leg 106*a* thereof defining an inner circumference 106 behind the ears 110 of base 90 (as seen in FIGS. 4A and 4B). The inner circumference 106*a* of the selector 100 and the ears 110 of the base 90 are cooperatively configured and dimensioned such that in one angular orientation (not shown) of the selector 100 relative to the base 90 the inner circumference 106*a* of the selector 100 blocks rearward movement of the base ears 110, while in another angular orientation of the selector 100 (as illustrated in FIG. 4B) the inner circumference 106*a* of the selector 100 permits rearward movement of the base ears 110 relative to and past the inner circumference 106*a* of the selector 100.

It will be appreciated by those skilled in the mechanical arts that such an engagement/disengagement relationship may be effected in a variety of different ways—e.g., as illustrated, by providing the back leg 106 of the selector 100 with an open area enabling passage of the base ears 110 therethrough but with a closed area or inwardly extending stops 108 which preclude such passage, or vice versa. Thus, one relative angular orientation of the selector 100 relative to the base ears 110 is such that the base ears are not in line with the stops 108 (see FIG. 4B), and the selector 100 then permits the base 90 to retreat past the selector 100; however, when the angular orientation of the selector is shifted relative to the base 90 (e.g., by 90°) such that the base ears 110 are now aligned with the stops 108, then rearward movement of the base element 90 is blocked by the selector 100.

Preferably the selector 100 is provided with a pair of limit stops 107 subtending an angle of about 90° (as best seen in FIG. 4A). The stops 107 are, of course, rotatable with the selector 100 relative to the back end piece 55. On the other hand, a fixed limit stop 109 is disposed on the back end piece 55, the fixed limit stop 109 being configured and dimensioned to preclude rotation of either rotatable limit stops 107 thereby. The network of limit stops 107, 109 defines the limits of angular rotation possible for the selector 100.

When the primary weapon 12 is to be used in the manually-driven mode, the desired angular orientation of the selector 100 is such that it enables relative rearward movement of the base 90 with the handle 44 relative to cylinder 40 (as there is no longitudinal alignment of the stops 108 and the base ears 110) so that there is no build-up of tension in spring 92. (Indeed, the user at this point may be entirely unaware of the existence of the biasing means 92.) On the other hand, when the primary weapon 12 is to be used in a spring-driven mode, the selector 100 is rotated to a new orientation (wherein the stops 108 are longitudinally aligned with and in the rearward travel path of the base ears 110, thereby to immobilize the base 90), so that forcible withdrawal of the handle 44 relative to the cylinder 40 causes the piston head 46 to approach immobilized base 90, thereby compressing spring 92. Forcible withdrawal of the handle 44 is therefore analogous to forcible pulling back on the string of a cross-bow, with the energy being stored in the spring 92 instead of the resilient part of the cross-bow. Once the handle 44 is released by the user, the same effect is obtained as if the handle 44 were directly pushing the piston head 46 forwardly with the force built-up in spring 92. It will be appreciated, however, that the handle 44 need not be withdrawn smoothly or rapidly, as the pressure build-up in the cylinder 46 by movement of the handle 44 is affected only by the position of the handle 44 relative thereto at the time it is released.

It will be appreciated that in those instances where the spring 92 is relatively weak, the amount of energy which may be stored therein and then released will be insufficient to propel the ball 24 or grenade 22 from the operative port, as these relatively large projectiles 22, 24 require more strength than the relatively lightweight arrow or plane projectiles 30, 28. Accordingly, in some embodiments of the present invention, the primary weapon 12, when operated as a spring-loaded propulsion means, may be useful for propelling arrows (this being the primary purpose of the spring-driven method of operation) or planes, but not balls or grenades.

The Primary Weapon as a Side Launcher

In addition to the primary or front port 50 already described, the primary weapon 12 has an auxiliary or side port from which projectiles may also be fired.

Thus, referring now in particular to FIGS. 2A and 5, the cylinder sidewall 41 and the front end piece 54 together define a side port 150 functionally similar to port 50. As in the case of port 50, there is a resilient seal 152 which is trapped between the sidewall 41 and the front end piece 54 in such a manner that it is easier to insert a ball 24 through stepped chamber 150 and past seal 152 than to propel a ball 24 outwardly past seal 152, but the engagement between the seal 152 and the front end piece 54 is direct (without any intermediary such as rigid ring 53). The port 150 also differs from port 50 in that there is no narrowing neck portion 50*a* to limit longitudinal retreat of the ball 24 along the cylinder 40. Accordingly, various lugs 154 (four being illustrated) are provided on the portions of the sidewall 41 opposite the port 150 in order to limit such motion of the ball 24. A recitation of further details of the port 150 is not deemed necessary herein, as the port 150 is in its significant aspects functionally similar to the port 50, except as noted herein.

Since there are two ports 50, 150 in gaseous communication with the cylinder 40, it is necessary to provide a cap generally designated 21 for pneumatically sealing one of the ports 50, 150 while the other port 50, 150 is in use. The cap 21 is releasably engageable with either of the ports 50, 150 and, in order to prevent loss of the cap 21, it is preferably secured to the end piece 54 intermediate the two ports 50, 150 by a flexible tether 21*a* so that it may easily be situated on either port. Referring now in particular to FIG. 2A, the cap 21 defines a port-entering end 21*b* of stepped decreasing outer diameter adapted to extend into and be releasably secured to the stepped chamber 50*b*, 150*b* of the port as far as and through the seal 52, 152 in order to create a pneumatic seal blocking the passage of air out of the port.

The Housing

Referring now to FIGS. 1, 2A and 7 in particular, the housing 14 is essentially non-functional with respect to the basic propelling functions of the toy 10 and is used primarily to provide an appropriate gun-like profile for the primary weapon 12, including a hand grip 200. The housing 14 additionally includes a forwardly projecting lug 202 for telescopically entering and supporting the back end of bayonet 18, a rearwardly open slot 204 adjacent the back of the housing for releasably receiving a forwardly projecting lug 205 on the back end piece 55' of the pistol 16, and a contoured support or cradle 206 adjacent the front of the housing for stabilizing the front end piece 54' of the pistol 16.

As earlier noted, the primary function of the housing 14, apart from connecting the various elements 12, 16, 18 of the toy 10 together, is to provide means for easy grasping of the primary weapon 12 so that the handle 44 thereof may be reciprocated relative to cylinder 40. At the front of the housing, the abutment of the bow pivots 62 and the front wall 208 of the housing precludes forward movement of the primary weapon 12 relative to the housing 14. However, in order to preclude rearward movement of the primary weapon 12 relative to the housing 14, means are provided for releasably locking the housing 14 and the primary weapon 12 together.

Figure 3B:
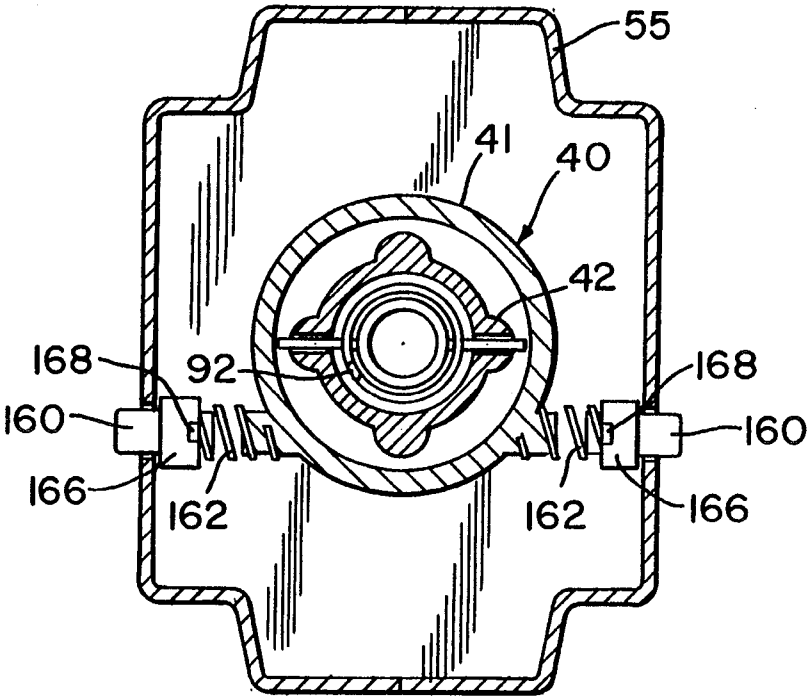
FIGS. 3A, 3B, 4A and 4B are sectional views taken along the lines 3A—3A, 3B—3B, 4A—4A and 4B—4B, respectively, of FIG. 2B and with the housing shown in FIGS. 3A and 3B.
Figure 3A:
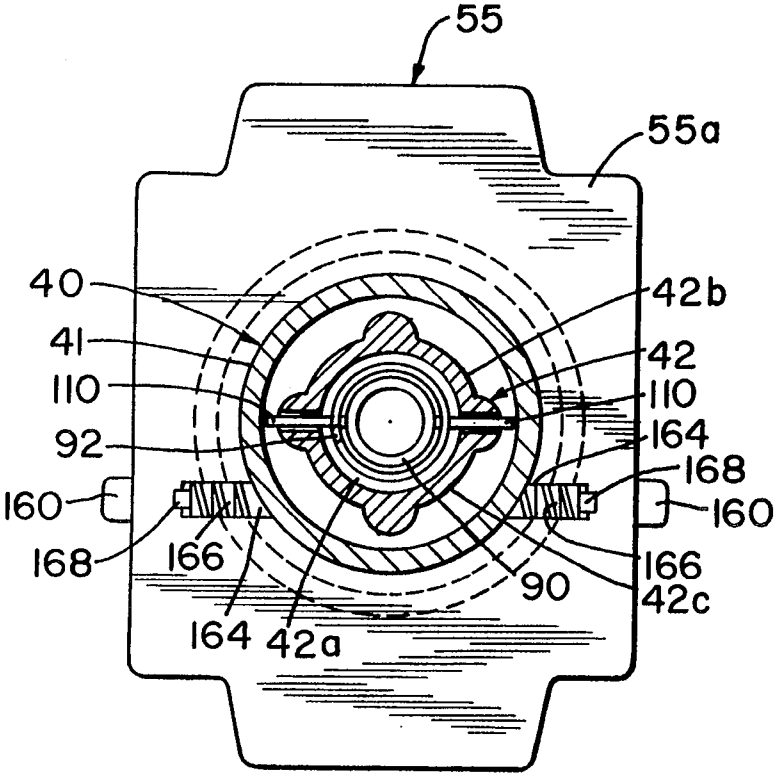

Referring now to FIGS. 2A, 3A and 3B in particular, the back plate 210 of the housing 14 abuts against the front wall 55*a* of the back end piece 55 of the primary weapon 12. A pair of diametrically opposed pushbuttons 160 on opposite sides of the housing 14 are biased outwardly (away from each other) by respective springs 162 which have one end secured about a projection 164 of the cylinder sidewall 41 and the other end bearing against a cross piece 166 secured to the pushbutton 160 for movement therewith. The forward end of each cross piece 166 passes through an aperture defined by the back plate 210 of the housing 14 and defines a ledge 168 which overlaps the back plate 210 and releasably secures the housing 14 to the primary weapon 12. When the pushbuttons 160 are pushed inwardly (toward one another), the ledges 168 disengage from the back wall 210 to enable easy manual separation of the housing 14 and the primary weapon 12. Preferably the forward end of each ledge 168 is sloped so that insertion of the primary weapon 12 into the housing 14 automatically provides the necessary inward camming of the ledges 168 so that the pushbuttons 160 do not have to be manually depressed during the insertion process.

The primary weapon 12 may be operated with or without the housing 14 in each of the modes described hereinabove except those involving the side port 150.

The Pistol

Figure 6:
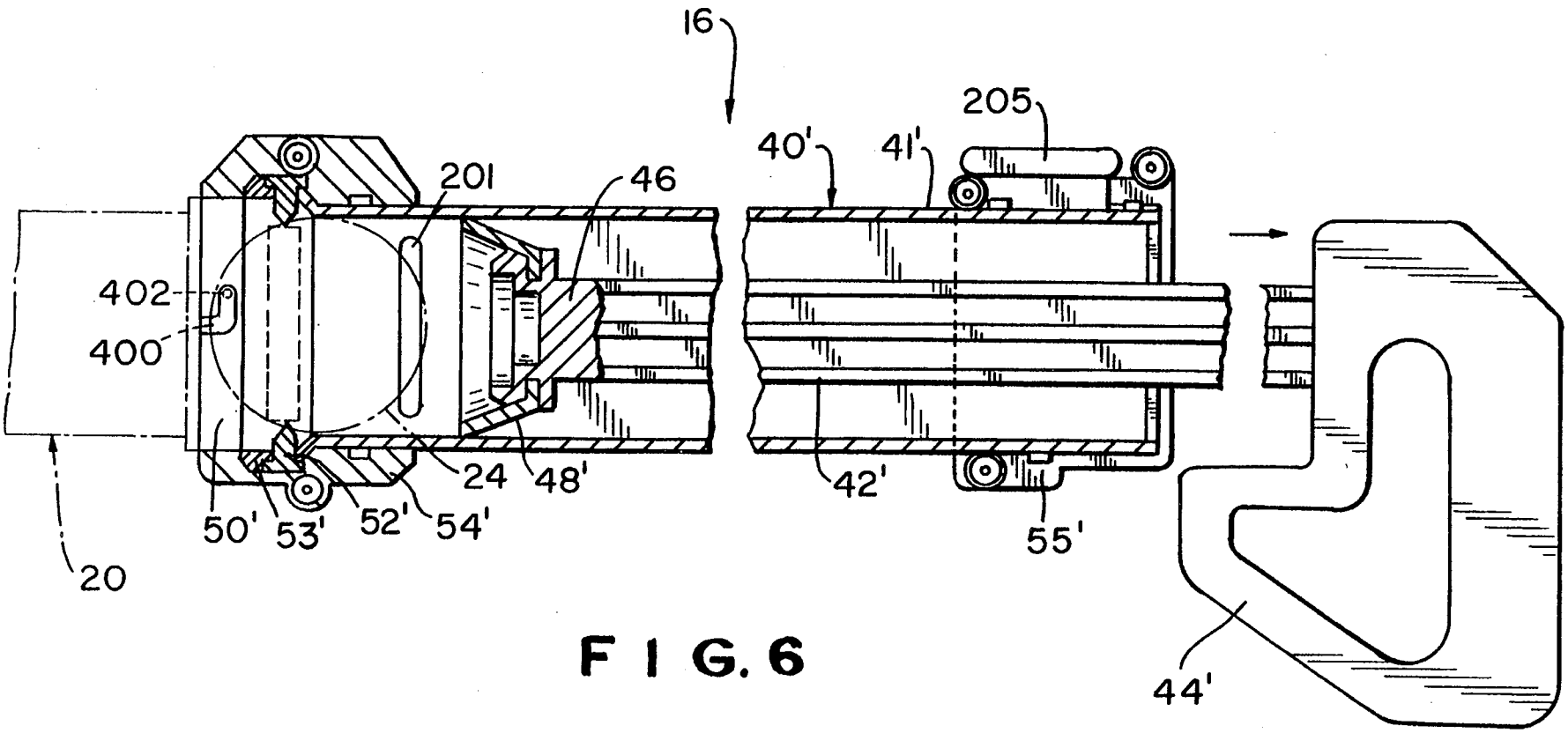
FIG. 6 is a fragmentary side elevational view of the pistol with a magazine attached and a ball projectile therein (both in phantom line)

Referring now to FIGS. 1 and 6, therein illustrated is a pistol 16. The pistol is in an inverted or upside-down storage position in FIG. 1 and in an upright use position in FIG. 6. The pistol 16 is typically stored on top of the housing 14 in the inverted or upside-down orientation so that the handle thereof does not interfere with the housing.

Elements of the pistol 16 which are functionally similar to elements of the primary weapon 12 are identified by like numerals primed. The pistol handle 44' is used to reciprocate the piston 42', including the piston head 46' (and the sealing member 48' thereof) longitudinally with respect to the sidewall 41' of cylinder 40'. The pistol piston 42' preferably has the cross section of an I-beam having an extra horizontal member therethrough. An inwardly extending detent 201 on sidewall 41' limits rearward movement of ball 24 within the cylinder 40' and ensures a pneumatic seal between the ball 24 and the resilient seal 52'. A grenade 22 or, as illustrated, a ball 24 may be fired from the port or chamber 50' (defined in part by the blow-molded cylinder 40' and the injection-molded front end piece 54'). Alternatively, as illustrated, the magazine 20 may be releasably secured to the pistol port 50', and a ball 24 (or balls 24) or a grenade 22 fired therefrom. In yet another alternative (not illustrated), the conversion means 70 may be releasably secured to the port 50', thereby to enable firing of planes 28 and arrows 30 therefrom as explained hereinbelow.

The pistol 16 is in its operative aspects structurally and functionally similar to the primary weapon 12, except that it has no side port 150 and no spring-driven method of operation so that it lacks counterparts of the elements associated with the spring-driven operation of the primary weapon 12 such as a selector, a spring, a split piston, etc. The pistol further lacks the bow halves 60 as there is no cross-bow method of operation thereof.

As best seen in FIG. 1, the pistol front end piece 54' is adapted to be cradled in housing cradle 206, and the pistol rear end piece 55' defines a forwardly projecting lug 205 adapted to be snugly received in rearwardly open housing slot 204, thereby to releasably join the pistol and the housing.

The Conversion Means

The primary weapon 12 and pistol 16, already described in connection with the launching of the ball 24 and grenade 22, may also be used to launch other projectiles such as the plane 28 and arrow 30, as illustrated with the housing 14 in FIG. 7 and without the housing 14 in FIG. 8, respectively.

The plane 28 (FIG. 7) and the arrow 30 (FIG. 8) are primarily thought of as accurate long-flight projectiles and are therefore expected to fly further and more accurately than the grenade 22. This can be accomplished only if the natural end-over-end tumbling of the projectile body—plane body 82 or arrow body 74—is restrained. (Tumbling of the sphere 24, of course, has little effect either way.) Furthermore, as opposed to grenades, real planes and arrows naturally follow travel paths without tumbling. Accordingly, these projectiles 28, 30 are disposed for flight not within a port 50, 50', 150 (which is a large diameter female member adapted to hold the ball 24 or grenade back end 22*a*), but rather on a small diameter male member projecting forwardly or outwardly of the port.

Accordingly, before either of these projectiles 28,30 is launched, a conversion means 70 is releasably secured to the operative port in pneumatic communication therewith, thereby converting the operative port from a large diameter female member to a small diameter male member.

Figure 10:
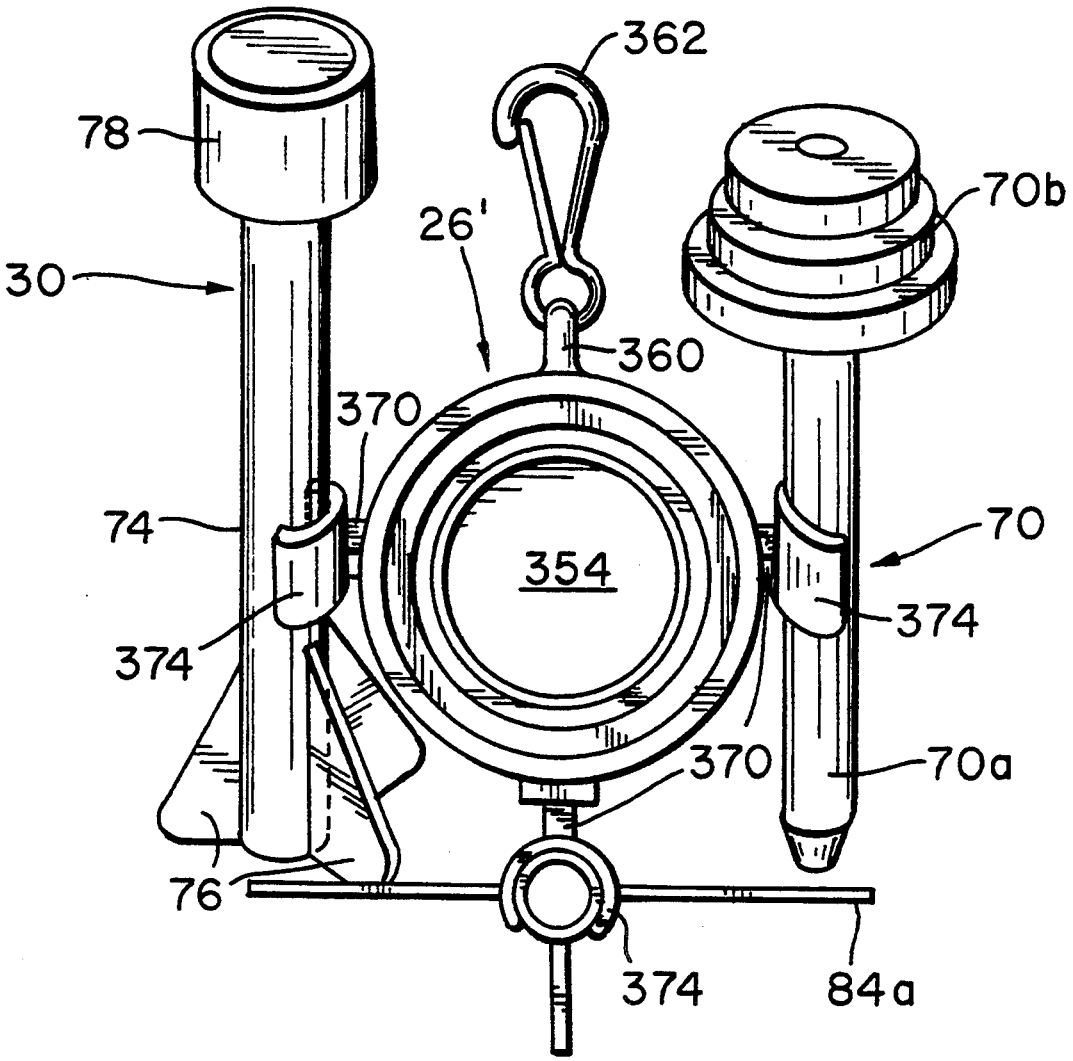

Referring now to FIGS. 7, 8 and 10, the conversion means 70 has at the front end thereof a hollow tube of narrow diameter 70*a* and at the back end thereof a port-engaging end 70b (similar to the cap end 21b) adapted to be releasably engaged in any one of the several ports of the toy 10. The conversion means 70 converts the low velocity, high pressure air stream entering the port-engaging end 70b from the port to a high velocity, low pressure air stream exiting its forwardly projecting tube 70a. The plane body 82 or arrow body 74 is slid rearwardly over tube 70a so that, when launched from the conversion means 70, it remains in contact with tube 70a for a relatively long period of time, even as the plane or arrow picks up speed, so that the tube 70a stabilizes the projectile 30, 28 against end-over-end tumbling. This differs from the case where the projectile is a grenade 22 or a ball 24 launched from a port and may commence to tumble almost immediately after it leaves the very short length of the port.

The forward tip of the projecting tube 70a of the conversion means 70 preferably defines a cross or cross-hair structure 70c within the tube 70a (see FIG. 8) so as to preclude, or at least render difficult, the insertion of unauthorized projectiles into the conversion means 70. The cross-hair structure 70c renders it either impossible or difficult to insert any type of projectile into the tube 70a or, if one is so inserted, to provide an adequate seal of the projectile with the tube 70a for enabling propelling of the projectile from the tube. On the other hand, the cross-hair structure 70c is configured and dimensioned not to materially impede the air flow through the conversion means.

The Bayonet

The bayonet 18 has no moving parts and is simply a futuristic bayonet-like design with a serrated blade 250, a hand-protecting section of enlarged diameter 252, and an elongated handle 254. The handle 254 defines a slot 256 at the back thereof adapted to releasably receive and be supported by the forwardly-projecting lug 202 of housing 14. Thus the bayonet 18 may be used as a bayonet or, after separation from the housing 14, as a dagger.

The Magazine

Referring now to FIGS. 1, 5 and 6, the magazine or ammunition clip 20 is adapted to be releasably secured to a port, such as port 50, 50', 150, so as to enable a plurality of missile- or ball-like projectiles 24 to be fired via the port without reloading. The magazine 20 comprises a blow-molded cylinder 300 having at the front thereof a port, generally designated 302 and similar to port 50 except as noted hereinafter, and at the back thereof a port-engaging end, generally designated 320 and similar to the port-engaging end 21b of the cap 21 except as noted hereinafter.

Unlike the port 50, pert 302 has no narrowing of the cylinder 300 in order to maintain a ball 24 in position against the resilient seal 304. The resilient seal 304 is trapped between the front of the blow-molded sidewall 300 and the back of a rigid ring 306, the ring 306 in turn being restrained by the front wall 308 of the front end piece 310. Unlike port-engaging end 21b of cap 21, the port-engaging end 320 is hollow so that the interior of the cylinder 300 is in pneumatic communication with the port to which it is attached.

The cylinder 300 of magazine 20 is preferably linear and of sufficient length to hold a plurality of balls, preferably 3. In order to insure that the lead ball 24 forms a pneumatic seal with the resilient seal 304 in port 302, the port-engaging end 320 is provided with a cross-hair reinforcing ring 322 which does not impede the passage of air therepast yet provides a fixed support against which a spring may be biased. Forwardly of the reinforcing ring 322 within the cylinder 300 is a cup-like pusher 324 which is sufficiently slotted or perforated so that it too does not impede the flow of air therepast. A helical compression spring 326 is secured at one end to reinforcing sing 322 and at the other end to the pusher 324, with a major portion of the compressed body of spring 326 being disposed within the pusher 324 as shown FIG. 5. The spring 326 continually biases the pusher 324 forwardly so that it bears against the back ball 24 directly, and any other balls in the magazine 20 indirectly, so that the lead ball 24 (which may also be the back ball) maintains a pneumatic seal with the resilient seal 304 in port 302. The inner diameter of the cylinder 300 is slightly larger than the outer diameter of the ball 324 so that air can freely pass the reinforcing ring 322 and pusher 324 to bear on the lead ball 24 and so that the ball 24 can easily move forwardly within the cylinder 300 under the influence of the pusher 324 until its passage is blocked by another ball or seal 304.

While in a preferred embodiment it is possible for the magazine 20 to be connected directly to the side port 150 of the primary weapon 12, typically the magazine 20 is directly connected only to the ports 50, 50' and only indirectly (via the elbow 26, 26') to the side port 150.

When the magazine 20 is placed on a port, that port must be devoid of the cap 21, the conversion means 70, and any ball 24 therein. Whereas the cap 21 or conversion means 70 would block the attachment of the magazine 20 to the port, the ball 24 in the port, even if it did not block the attachment of the magazine 20 to the port, would block the desired air flow from the port through the magazine.

While the magazine 20 enables rapid firing in succession of a plurality of balls 24 without reloading, obviously it can also be used with merely a single ball 24 for single shot operation.

The Elbow

Figure 9:
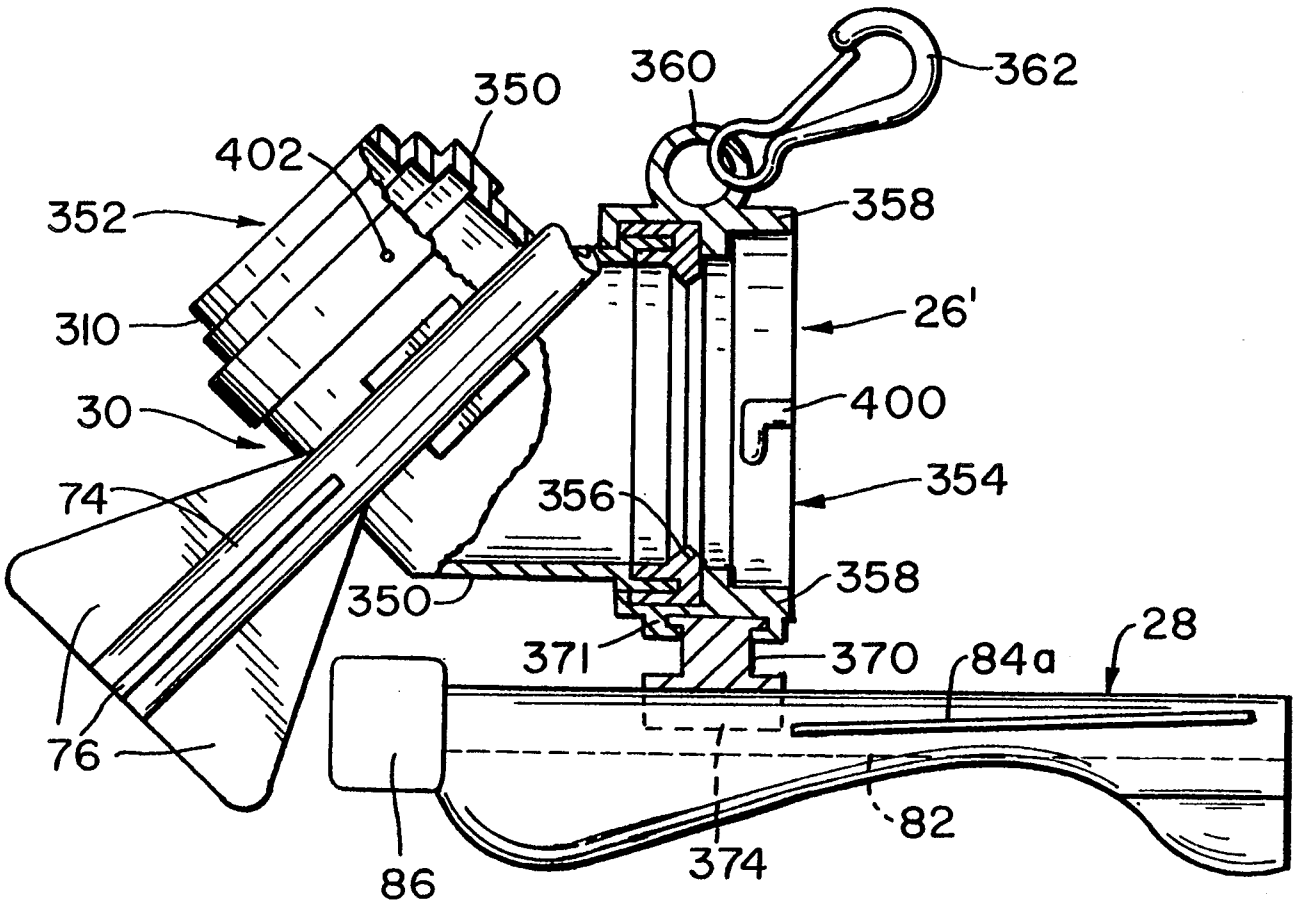
FIGS. 9 and 10 are a side elevational view and a front elevational view, partially in section, respectively, of an elbow, for use as a carrier for various accessories not shown in FIG. 1.

Referring now to FIGS. 5 and 9–10, the elbow 26 is of simple construction yet serves a number of different functions. In its simplest aspect, the elbow 26 is formed simply of a sidewall 350 which defines a bend therein, preferably a bend of about 45°. At on end of the elbow 26 is a port-engaging end 352 similar to the port-engaging end 21b of cap 21 except that it is hollow so that the interior of sidewall 350 is in pneumatic communication with the port to which it is attached. At the other end of the elbow 26 is a port 354 similar to the port 50 of the primary weapon 12. Thus, a resilient member 356 is trapped between the front end of blow-molded sidewall 350 and a portion of an injection-molded front end piece 358. Unlike the port 50 at the front end of the primary weapon 12, no narrowing of sidewall 350 is required to prevent a ball 24 placed in elbow port 354 from passing rearwardly through the cylinder 350 since the angle of the elbow 26 impedes such a travel path. Depending upon the angle formed by the elbow 26 and the interior design of the cylinder 350, it may or may not be possible for a ball 24 to pass from a port of the primary weapon 12 through the elbow 26. This is of only minor import as it would be difficult to reload the port with a new ball 24 while the elbow 26 was still releasably secured to the port. Indeed, where an embodiment of the elbow 26 is of relatively short overall length, the port 354 may itself be too small to accommodate a ball 24. Again this is of little import, as typically the elbow 26 is used in conjunction with the magazine 20 and merely serves as a connector and realigner of the magazine 20 relative to a port of the primary weapon 12.

Typically the elbow 26 is disposed intermediate the side port 150 of the primary weapon 12 and the port-engaging end 320 of magazine 20. If the magazine 20 is directly secured to the side port 150 of the primary weapon 12, then the ball 24 is fired in the same direction from the magazine 20 as it would be from the port 150, namely, directly transverse to the longitudinal axis of the primary weapon 12. As the side port 150 of the primary weapon 12 is typically used when the front port 50 (with the sealing cap 21 thereon) is pressed against the ground G (see FIG. 5), the travel path of the ball emerging from either the side port 150 or the magazine 20 would be relatively close to the ground G and would not mimic or simulate the conventional parabolic trajectory of a lobbed missile. The elbow 26 solves this problem by allowing the air stream to pass from the port 150 into and through the elbow 26, where it is turned upwardly, and then to continue through the magazine 20, so that the magazine 20 propels the ball 24 in a ballistic trajectory.

Referring now to FIGS. 9–10, therein illustrated is a preferred embodiment 26' of the elbow 26. Like the elbow 26, the preferred embodiment 26' includes a sidewall 350 having at one end thereof a port 354 and at the other end thereof a port-engaging end 352 and functions to redirect the air flow travel path- However, the elbow 26' is also adapted for use as a carrier separate and apart from the main portion of the toy 10 illustrated in FIG. 1. Thus, the injection-molded front end piece 358 (or the back end piece) additionally defines user-attachment means such as a ring 360 and a conventional clip 362 passing through the ring 360 for releasably securing the elbow 26', for example, to the belt (not shown) of a person playing with the toy 10.

A plurality of connecting members generally designated 370 are provided, each secured at one end to elbow 26' and defining at the other end an inwardly-biased resilient pair of fingers 374. As illustrated in FIG. 9, the connecting member 370 has one end passing through a slot 371 provided in the end piece 358 (although it could be the other end piece 310) and the other end defining a pair of fingers 374 releasably grasping either the hollow tube 74 of an arrow 30 or the hollow tube 82 of a plane 28. The number of connecting members 370 may be varied, as desired, in order to accommodate the number and type of projectiles to be carried.

A conversion means 70 may have its port-engaging end **70*b* releasably engaged with the port 354 of the elbow 26' (not shown) or, as illustrated in FIG. 10, one pair of the fingers 374 may be specially adapted to releasably grasp the narrower tube 70*a* of a conversion means 70 (relative to the tubes 74, 82) and thereby secure it to conversion means 26' in the same manner as a plane 28 or arrow 30. If desired, a ball 24 or grenade 22 may also be carried in the port 354** thereof.

The Projectiles

The ball 24 is substantially rigid and foam-free. While the ball 24 may have some resiliency, it is more like a ping pong ball than a tennis ball and is preferably formed of blow-molded plastic. It is configured and dimensioned to fit loosely within chamber 50 and provide a pneumatic seal with the seal 52.

Referring now to FIG. 1, the grenade 22 is provided with a ball-like back portion **22*a* which is releasably received within the chamber 50 (like the ball 24) so that the primary weapon 12 can also be used without modification in order to launch grenades 22. In point of fact, the configuration of the forward portion of grenade 22 can vary greatly so long as the back portion thereof is configured and dimensioned like ball 24 so as to be sealable within the chamber 50 and provide the desired pneumatic seal with the seal 52. Like ball 24**, the grenade is preferably formed of blow-molded plastic.

As illustrated in FIG. 8, the lightweight arrow 30 is formed of an airtight hollow tubular body 74 adapted to receive therein from the rear the tube **70*a* of the conversion means 70 so that the arrow 30 is supported thereby. The rear end of the arrow body 74 is provided with flight-stabilizing vanes 76, and the front end is provided with a soft head 78, preferably formed from a closed cell, substantially non-porous foam which acts as protection for both the arrow 30 and any object or person impacted thereby, as well as to operatively close the forward end of the arrow body 74. Accordingly, the air propelled from chamber 50 and conversion means 70 at high velocity acts on the arrow head 78 to cause the arrow 30 to separate from the conversion means 70** and commence flight.

As illustrated in FIGS. 7 and 9, the lightweight plane 28 is formed of an airtight hollow tubular body 82 (functionally and structurally similar to arrow body 74) adapted to receive therein from the rear the tube **70*a* of conversion means 70 so that the plane 28 is supported thereby. A plane-like profile 84 is disposed over plane body 82 to afford the appearance of a plane with wings 84*a*, and a soft head 86 (functionally and structurally similar to arrow head 78) is provided over the front end of body 82**.

Ports and Port-Engaging Ends

There are four ports according to the present invention: the front port 50 and the side port 150 of the primary weapon 12, the front port 50' of the pistol 16, and the front port 354 of elbow 26, 26'. While the front ports 50, 50' of the primary weapon 12 and pistol 16 will always be of sufficient size to accommodate a ball 24 or the rear end **22*a* of a grenade 22, in particular embodiments the side port 150 of the primary weapon 12 and the front port 354 of elbow 26, 26' may be too small to accommodate such projectiles. The various ports may also differ in certain other respects—for example, whereas the front port 50 of the primary weapon 12 contains an independent ring 53 and the port 50' of pistol 16 contains a ring 53', the side port 150 of the primary weapon 12 and the port 354 of elbow 26, 26' may have the forward edge of the resilient seal thereof contacted directly by the injection-molded front end piece 150*b*, 358**, respectively, without any ring member therebetween.

Nonetheless, each of these ports 50, 50', 150 and 354 is adapted to receive the port-engaging end of another element and, to that end, defines a diametrically opposed pair of L-shaped slots 400 adapted to releasably receive and engage projecting pins 402 of the port-engaging ends of the other elements. The forward end 302 of magazine 20 is similar to a port (and contains a ring 306) and differs only in that no slot 400 is defined therein as it is not intended that any element will be connected to the front end 302 of the magazine 20.

Similarly, the port-engaging elements—namely, the end 21*b* of cap 21, the end 70*b* of conversion means 70, the end 352 of elbow 26, 26' and the end 320 of magazine 20 are each provided with a diametrically opposed pair of outwardly projecting pins 402 adapted to be received within and engaged in a bayonet-type relationship with the slots 400 of the various ports. As will be appreciated by those skilled in the mechanical fastener art, the slot/pin 400/402 engagement system could be replaced by a pin/slot engagement system, with the slots being disposed on the port-engaging ends and the pins being disposed on the ports. Alternatively, if desired, other cooperating engagement systems well known in the mechanical fastener arts could be used, including other male/female systems, threaded systems, and the like.

General

With the exception of the springs 92, 162, the foam tips 78, 86 of the arrow and airplane, the tether 21 and the resilient seals within each port, the entire toy may be fabricated of high-strength plastic. The seals of ports 150 and 354, which typically do not include projectiles (although in some embodiments they may), are preferably formed of a resilient plastic such as polyvinyl chloride, while the seals of ports 50, 50' and 302, which typically include projectiles, are preferably formed of silicone. The blow-molded pieces, such as the balls 24 and the various cylinders of the primary weapon 12, pistol 16, magazine 20, and elbow 26, are preferably formed of polyethylene. The remainder of the toy 10, including the piston 42, the injection-molded end pieces, and the housing 14 thereof, is preferably formed of polystyrene for extra rigidity and strength.

The terms "spring-driven" and "manually-driven" as used herein and in the claims are used to specify the means by which the projectile is propelled and not the means for accumulating the propulsion force used to propel the projectile. In other words, the term "driven" refers to the means for propelling the projectile and not the means for cocking the propulsion means.

To summarize, the present invention provides a multi-concept projectile-propelling toy which incorporates a plurality of single-concept toys. The toy includes a plurality of ports and a plurality of propulsion means for propelling a variety of different types of projectiles via the ports, the various propulsion means being separate and independent and at least one being pneumatic. The toy is convertible so that the user can select between manually-driven and spring-driven propulsion means for added play valve. The present invention further provides a kit which includes such a toy and a magazine which enables repeated firing of particular projectiles from the various propulsion means without reloading.

Now that the preferred embodiments of the present invention have been shown and described in detail, the various modifications and improvements thereon will become readily apparent to those skilled in the art. Accordingly, the spirit and scope of the present invention is to be construed broadly and limited only by the appended claims, not by the foregoing specification.

We claim:

1. A projectile-propelling toy comprising:

(A) a first port and a first propulsion means for propelling a projectile via said first port; and (B) a second port and a second propulsion means for propelling a projectile via said second port;

said first and second propulsion means being separately and independently driven, said first and second propulsion means being pneumatic, one of said propulsion means being manually-driven and another of said propulsion means being spring-driven.

2. The toy of claim 1 additionally including a third port and a third propulsion means for propelling a projectile via said third port.

3. The toy of claim 2 wherein at least two of said propulsion means are simultaneously operable.

4. The toy of claim 2 wherein said third propulsion means differs from at least one of said first and first second propulsion means in how it is driven.

5. The toy of claim 2 wherein said first, second and third propulsion means are net simultaneously operable.

6. The toy of claim 1 wherein said one propulsion means is not spring-driven and said another propulsion means is not manually-driven.

7. The toy of claim 1 wherein some of the projectiles are adapted for being propelled via a female member and others of the projectiles are adapted for being propelled via a male member, and additionally including conversion means releasably securable to at least one of said ports for converting said one port from a female member to a male member.

8. The toy of claim 1 wherein some of the projectiles are adapted for being propelled via a large diameter member and others of the projectiles are adapted for being propelled via a relatively small diameter member, and additionally including conversion means releasably securable to at least one of said ports for converting said one port from a large diameter member to a relatively small diameter member.

9. A projectile-propelling toy comprising:

(A) a first port and a first propulsion means for propelling a projectile via said first port; and (B) a second port and a second propulsion means for propelling a projectile via said second port;

said first and second propulsion means being separately and independently driven, at least one of said first and second propulsion means being pneumatic, and said first and second propulsion means being configured to propel projectiles via the same one of said ports.

10. The toy of claim 9 wherein said at least one of said propulsion means and said at least another of said propulsion means are configured to propel projectiles via said same one of said ports.

11. The toy of claim 10 additionally including means for manually selecting which of said at least one of said propulsion means and said another of said propulsion means is operable to propel a projectile via said same one of said ports.

12. projectile-propelling toy comprising:

(A) a first port and a first propulsion means for propelling a projectile via said first port; and (B) a second port and a second propulsion means for propelling a projectile via said second port;

said first and second propulsion means being separately and independently driven, said first and second propulsion means being pneumatic;

said toy being easily and reversibly separable into two independent and distinct projectile-propelling devices, each said device having a respective one of said first and second ports and a respective one of said first and second propulsion means.

13. A kit for a projectile-propelling toy comprising:

(A) a first weapon including first pneumatic propulsion means for propelling a projectile therefrom;

(B) a second weapon including second pneumatic propulsion means for propelling a projectile therefrom;

(C) a housing including means for releasably receiving said first weapon thereon and means for telescopically receiving at least a major portion of said second weapon therein; and (D) a magazine adapted to be releasably received in functional engagement by each of said first weapon, said second weapon and said housing.

14. The kit of claim 13 wherein, when said housing telescopically receives at least a major portion of said second weapon therein, said second propulsion means is operable in said housing.

15. The kit of claim 13 wherein said magazine enables rapid multiple firing of projectiles by said first weapon when mounted thereon, without reloading.

16. The kit of claim 13 wherein said second propulsion means is manually-driven, said second weapon additionally includes third pneumatic propulsion means for propelling a projectile therefrom, said third propulsion means being spring-driven, and means ere provided for selecting which of said second and third propulsion means is operative at a given time.

17. The kit of claim 13 additionally including as projectiles at least one ball, at least one arrow, at least one missile, and at least one plane.

18. The kit of claim 13 additionally including elbow means to enable directional guidance of a projectile propelled by said second propulsion means from said second weapon when mounted thereon.

19. A convertible projectile-propelling toy comprising:

(A) manually-driven pneumatic propulsion means for propelling a projectile therefrom;

(B) spring-driven pneumatic propulsion means for propelling a projectile therefrom; and (C) means for manually selecting which of said pneumatic propulsion means is operative at a given time.

20. The toy of claim 19 including a given port, and wherein said manually-driven propulsion means and said spring-driven propulsion means both drive projectiles via said given port.

21. The toy of claim 19 including first and second ports, and wherein said manually-driven propulsion means drives a projectile via said first port, and said spring-driven propulsion means drives a projectile via said second port, said first and second ports being different.

22. The toy of claim 21 additionally including means for releasably sealing a port, said sealing means being manually switchable between a first position sealing said first port and a second position sealing said second port.

23. The toy of claim 22 wherein each of said manually-driven and spring-driven propulsion means is capable of propelling a projectile through either one of said first and second ports when said sealing means is in a position sealing the other of said first and second ports.

24. A projectile-propelling toy having a primary power unit comprising:

(A) an axially extending tube having a front end, a back end, a sidewall joining said tube front and back ends, and a hollow tube interior;

(B) a plurality of ports in gaseous communication with said tube interior for propelling a projectile therefrom, one of said ports extending through said tube front end and one of said ports extending through said tube sidewall; and (C) piston means extending through said tube back end and into said tube interior for axial movement relative to said tube for pneumatically propelling a projectile via one of said ports.

25. The toy of claim 24 wherein said primary power unit additionally includes biasing means for causing relative movement of said piston means and said tube.

26. The toy of claim 24 additionally including a housing defining a hollow interior configured and dimensioned to telescopically receive therein at least a portion of said primary power unit, and an exterior including means for releasably securing to said primary power unit at least one additional device.

27. The toy of claim 26 wherein said housing exterior includes means for releasably securing to said primary power unit at least two additional devices.

28. The toy of claim 24 additionally including means secured thereto for releasably sealing against gaseous communication a selected one of said ports.

29. The toy of claim 24 additionally including hollow elbow means, releasably securable to a port, for modifying the direction of travel of a projectile propelled via the port and through said elbow means.

30. The toy of claim 29 wherein said elbow means modifies the direction of travel by a fixed angle.

31. The toy of claim 30 wherein said elbow means defines a first end defining a port, a second end for releasable connection to one of said ports of said primary power unit for establishing gaseous communication with said tube interior, and a body connecting said elbow means ends and defining a fixed angle of 35°–55°.

32. The toy of claim 31 wherein said elbow means free end is configured and dimensioned for releasable connection with a hollow launcher for gaseous communication therewith.

33. The toy of claim 32 wherein said launcher includes magazine means for storing a plurality of projectiles for firing from said launcher.

* * * * *